US006986244B2

(12) United States Patent
Burchert

(10) Patent No.: US 6,986,244 B2
(45) Date of Patent: Jan. 17, 2006

(54) OPEN-END SPINNING ROTOR

(75) Inventor: Mathias Burchert, Ostfildern (DE)

(73) Assignee: Maschinenfabrik Rieter AG, Winterthur (CH)

( * ) Notice: Subject to any disclaimer, the term of this patent is extended or adjusted under 35 U.S.C. 154(b) by 92 days.

(21) Appl. No.: 10/700,676

(22) Filed: Nov. 5, 2003

(65) Prior Publication Data

US 2004/0088965 A1 May 13, 2004

(30) Foreign Application Priority Data

Nov. 5, 2002 (DE) ..... 102 52 487

(51) Int. Cl.
*D01H 4/10* (2006.01)

(52) U.S. Cl. ..... 57/416

(58) Field of Classification Search ..... 57/404–417
See application file for complete search history.

(56) References Cited

U.S. PATENT DOCUMENTS

| | | | | |
|---|---|---|---|---|
| 4,245,460 | A * | 1/1981 | Staufert et al. | 57/415 |
| 5,718,110 | A * | 2/1998 | Stahlecker | 57/416 |
| 6,195,976 | B1 | 3/2001 | Wassenhoven et al. | 57/414 |
| 6,269,623 | B1 * | 8/2001 | Phoa et al. | 57/417 |

FOREIGN PATENT DOCUMENTS

| | | |
|---|---|---|
| DE | 199 10 277 | 9/2000 |

* cited by examiner

*Primary Examiner*—John J. Calvert
*Assistant Examiner*—Shaun R Hurley
(74) *Attorney, Agent, or Firm*—Crowell & Moring LLP

(57) ABSTRACT

An open-end spinning rotor has its thinnest wall thickness in the area of its fiber collecting groove. The lateral wall of the open-end spinning rotor comprises an outer contour, which—in axial section—is at least partly convex-shaped. The wall thickness of the lateral wall is increased along a portion of its length by a curved widening contour.

21 Claims, 1 Drawing Sheet

OPEN-END SPINNING ROTOR

BACKGROUND AND SUMMARY OF THE INVENTION

This application claims the priority of 102 52 487.4 filed in Germany on Nov. 5, 2002, the disclosure of which is expressly incorporated by reference herein.

The present invention relates to an open-end spinning rotor, which—beginning at an open front side—comprises walls, one after the other, in the form of a lateral wall and in the form of a rotor base, comprising an inner contour bordering the lateral wall, which inner contour widens conically beginning from the open front side up to a fiber collecting groove, which has the largest inner diameter, also comprising an outer contour bordering the lateral wall, which outer contour increases in diameter from the open front side to its largest outer diameter size which is located in the area of the fiber collecting groove, also comprising the walls having different thicknesses, of which the wall thickness is at its thinnest in the area of the fiber collecting groove, while the wall thickness of the lateral wall is thinner than that of the rotor base.

An open-end spinning rotor of this type is prior art in German published patent application DE 199 10 277 (corresponding U.S. Pat. No. 6,195,976).

The known open-end spinning rotor is designed for speeds of up to 150,000 rpm, whereby the particular chosen dimensions should eliminate the risk of bursting due to too high a component tension. One of the ways this is achieved is that the open-end spinning rotor has its thinnest wall thickness in the area of its fiber collecting groove and that the wall thickness of the lateral wall is thinner than that of the rotor base. The wall thickness of the rotor base increases again in the direction of the shaft of the open-end spinning rotor. Thus an improved mass distribution and also a better running at high speeds is achieved. As the largest outer diameter is reduced despite maintaining the diameter of the fiber collecting groove, an additional reduction in weight is also achieved, which also contributes to the desired effect.

Despite these advantageous features, it was not recognized that in the case of the open-end spinning rotor, the maximum tension during operation is located in the middle of the lateral wall. It is, therefore, disadvantageous when the outer contour of the lateral wall in the known open-end spinning rotor is—in axial section—designed to be straight and that the wall thickness of the lateral wall increases constantly from the open front side to the fiber collecting groove.

It is an object of the present invention to further optimize the known open-end spinning rotor with regards to its operational component tension.

This object has been achieved in accordance with the present invention in that the outer contour of the lateral wall in axial section is at least partly convex in shape.

The wall thickness of the lateral wall, irrespective of whether viewed from the front side of the open-end spinning rotor or the largest outer diameter, first increases and then decreases again, according to the convex curve of the outer contour, to which—also in axial section—a straight-lined inner contour is disposed. The lateral wall thus has its greatest thickness in the area of its maximum tension. All the advantages which the open-end spinning rotor possessed in prior art are retained, in particular the thinnest wall thickness in the area of the fiber collecting groove, that is, where too much mass is undesirable in the case of high speeds.

In an embodiment of the present invention it is provided that the lateral wall comprises a curve in the convex designed area, which curve increases towards the open front side. For example, the curve—in axial section—in the area of the open front side can have a radius of 10 mm, while in a middle area of the lateral wall directly downstream thereof, the radius measures almost double the thickness. The wall thickness decreases more towards the open front side, that is, where less material is required as a result of the operational tensions.

It can be further provided that the lateral wall comprises a concavely designed transition area in the direction of the greatest diameter. The convexly designed area is located primarily in the middle area of the lateral wall and in the area of the open front side of the open-end spinning rotor and graduates via the concave form of the transitional area to the reduced wall thickness in the area of the fiber collecting groove.

These and further objects, features and advantages of the present invention will become more readily apparent from the following detailed description thereof when taken in conjunction with the drawing.

DETAILED DESCRIPTION OF THE DRAWING

Figure 1:
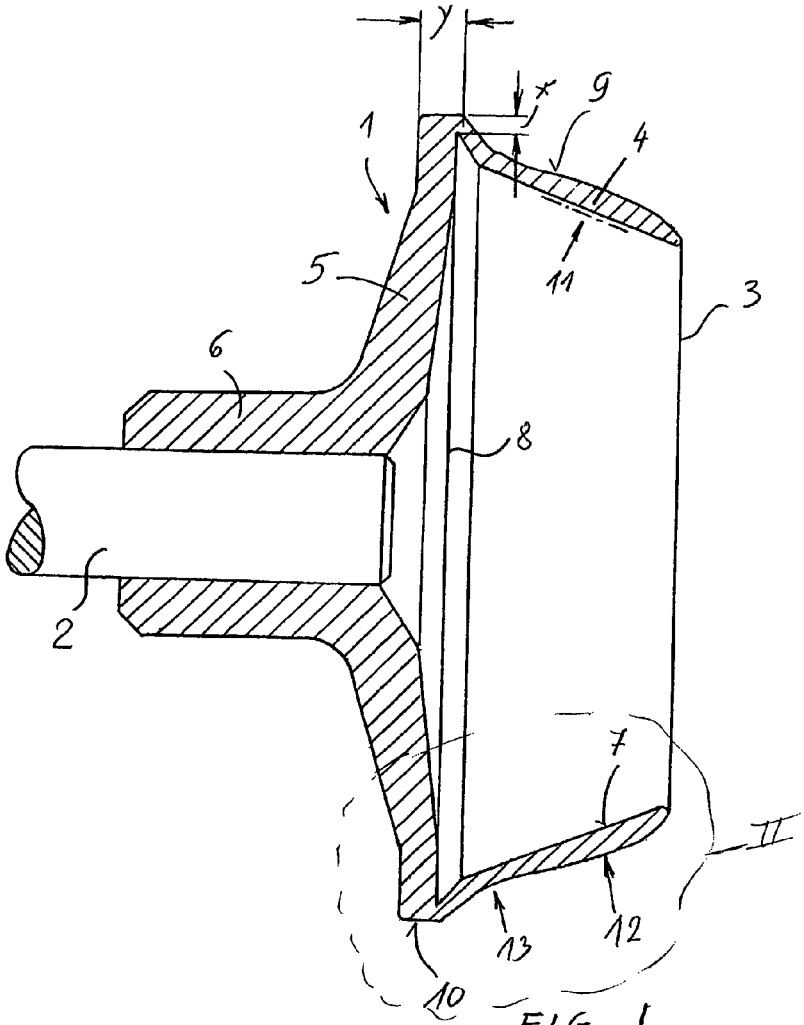
FIG. 1 is an enlarged sectional view of an open end spinning rotor constructed according to a preferred embodiment of the present invention.

The open-end spinning rotor 1 is connected fixedly in a known way to a rotatable shaft 2, which is supported and driven in a way not shown. Beginning at an open front side 3, the open-end spinning rotor 1 comprises walls, one after the other in the form of a lateral wall 4 and a rotor base 5 adjoined thereto, which in turn graduates to a collar 6. The collar 6 serves to press the open-end spinning rotor 1 onto a rotor shaft 2.

The lateral wall 4 is bordered by an inner contour 7, which forms in a known way a fiber sliding surface during operation of the open-end spinning rotor 1. The inner contour 7 extends from the open front side 3 to a fiber collecting groove 8, which has the largest inner diameter and in which, during operation, fed single fibers are twisted into a spun thread. As can be seen, the inner contour 7 widens conically to the fiber collecting groove 8, whereby the inner contour 7 extends in axial section in a straight line.

The lateral wall 4 is bordered by an outer contour 9, which increases in diameter from the open front side 3 to its largest outer diameter 10. The largest outer diameter 10 is located in the area of the fiber collecting groove 8.

During operation of the high-speed rotating open-end spinning rotor 1, single fibers are released from a sliver and shot, with the aid of an air stream, against the inner contour 7, from where they slide into the fiber collecting groove 8 and are there bound into the spun thread. This process is already known and is not shown here. Due to ever increasing production speeds, open-end spinning rotors 1 rotate at speeds up to 150,00 rpm, thus increasing the risk of bursting due to the very high vibrations of the component parts. In order to reduce this risk, it is provided in the case of the known open-end spinning rotor as well as in the embodiment of the present invention that the individiual walls have different thicknesses. Thus the wall thickness x, for example, in the area of the fiber collecting groove 8, is the thinnest. In additon to that, the wall thickness of the lateral wall 4 is thinner than that of the rotor base 5. The wall thickness of the lateral wall 4 increases towards the shaft 2. With these measures an improved mass distribution and an improved running at high speeds is achieved.

In the case of known open-end spinning rotors, it was not recognized that in the area 11, denoted by a dot-dash line in the drawing, a particularly high component tension was present. For this reason, while retaining the known inner contour 7, the wall thickness of the lateral wall 4 is designed in a particular variable form according to the present invention. It is provided in accordance with the present invention that the outer contour 9 of the lateral wall 4—in axial section—has at least one partly convex area 12.

Starting at the thinnest wall thickness x in the area of the fiber collecting groove 8, the wall thickness of the lateral wall 4 increases first and then decreases again towards the open front side 3. Due to the convexly shaped area 12, the lateral wall 4 obtains its greatest wall thickness there where the maximum tension occurs. The advantages mentioned above, insofar as they are also present in the known open-end spinning rotor, are retained in full.

The curve of the convexly shaped area 12 of the outer contour 9 is so chosen that it increases towards the open front side 3, for example from a radius of 22 mm to a radius of 10 mm, as seen in axial section. It is also provided that the lateral wall 4 comprises a concavely shaped transitional area 13 towards its largest outer diameter 10.

As already mentioned above, the wall thickness of the lateral wall 4 should be thinner than the wall thickness of the rotor base 5. The thinnest wall thickness y of the rotor base 5, located in the area of the largest outer diameter 10, is thicker than the thinnest wall thickness x radially outside of the fiber collecting groove 8. The thicker material at the rotor base 5 is necessary, amongst other things, for balancing, when material may have to be removed. It is advantageous when y measures approximately between 1.5 times to twice the amount of x.

Figure 2:
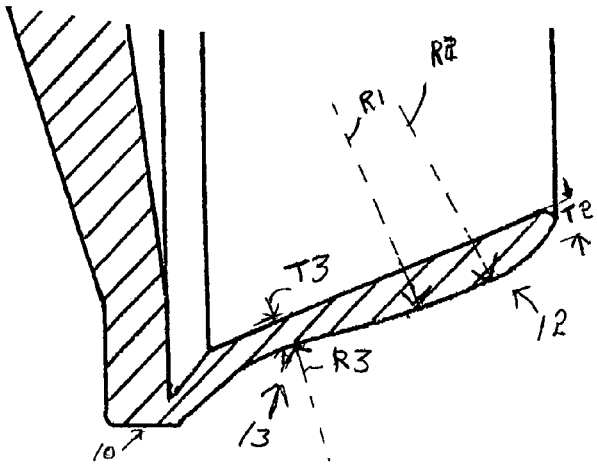
FIG. 2 is an enlarged detail view of section II of FIG. 1.

Referring to FIG. 2, the following dimensions exemplify a preferred embodiment of the invention with an outside rotor diameter 10 of 48.7 mm. The concavely shaped section 13 has a minimum thickness T3 of 1.1 mm and a radius of curvature R3 at this thinnest section of 12.5 mm. The convex section 12 has a maximum thickness T2 of 1.35 mm and a radius of curvature R2 at the thickest section of 10.0 mm. The section intermediate the thinnest and thickest sections has a radius R1 of about 22 mm. It should be understood that the radius of curvature intermediate the points of the shown radius R1, R2 and R3 will vary to form a smooth transition of the curved outer surface of the rotor. The minimum thickness T3 and maximum curvature R3 and R2 will be substantially the same for a range of rotor diameters used in existing practical commercially available machines while the radius R1 may vary substantially. These dimensions are exemplary and practical contemplated embodiments can have variations of ±10% as long as the relative ratios of thin and thick sections are also maintained so as to provide the convexly shaped area 12 with maximum thickness where maximum tension occurs.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Open-end spinning rotor, which—beginning at an open front side—comprises walls, one after the other, in the form of a lateral wall and in the form of a rotor base, comprising an inner contour bordering the lateral wall, which inner contour widens conically beginning from the open front side up to a fiber collecting groove, which has the largest inner diameter, also comprising an outer contour bordering the lateral wall, which outer contour increases in diameter from the open front side to its largest outer diameter size which is located in the area of the fiber collecting groove, also comprising the walls having different thicknesses, of which the wall thickness in the area of the fiber collecting groove is the thinnest, while the wall thickness of the lateral wall is thinner than that of the rotor base, wherein the outer contour of the lateral wall—in axial section—is at least partly convex-shaped, and wherein the thickness of the wall is increased by a curved widening contour.

2. Open-end spinning rotor, which—beginning at an open front side—comprises walls, one after the other, in the form of a lateral wall and in the form of a rotor base, comprising an inner contour bordering the lateral wall, which inner contour widens conically beginning from the open front side up to a fiber collecting groove, which has the largest inner diameter, also comprising an outer contour bordering the lateral wall, which outer contour increases in diameter from the open front side to its largest outer diameter size which is located in the area of the fiber collecting groove, also comprising the walls having different thicknesses, of which the wall thickness in thearea of the fiber collecting groove is the thinnest, while the wall thickness of the lateral wall is thinner than that of the rotor base, wherein the outer contour of the lateral wall—in axial section—is at least partly convex-shaped, and wherein the lateral wall has a curve in a convexly designed area, which curve increases in the its radius towards the open front side.

3. Open-end spinning rotor according to claim 1, wherein the lateral wall has a concavely designed transition area towards the greatest outer diameter.

4. Open-end spinning rotor according to claim 2, wherein the lateral wall has a concavely designed transition area towards the greatest outer diameter.

5. Open-end spinning rotor according to claim 1, wherein, in the area of the largest outer diameter, the wall thickness of the rotor base measures 1.5 times to twice the size of the smallest wall thickness.

6. Open-end spinning rotor according to claim 2, wherein, in the area of the largest outer diameter, the wall thickness of the rotor base measures 1.5 times to twice the size of the smallest wall thickness.

7. Open-end spinning rotor according to claim 3, wherein, in the area of the largest outer diameter, the wall thickness of the rotor base measures 1.5 times to twice the size of the smallest wall thickness.

8. Open-end spinning rotor according to claim 4, wherein, in the area of the largest outer diameter, the wall thickness of the rotor base measures 1.5 times to twice the size of the smallest wall thickness.

9. An open-end spinning rotor comprising:

an annular wall extending conically from a rotor open-end to form a fiber collecting groove at a largest diameter section of the annular wall, and a rotor base extending from the fiber collecting groove to a rotor support section, wherein said annular wall exhibits an interior wall surface facing radially inwardly toward a rotor rotational axis and a radially outwardly facing exterior wall surface, wherein said interior wall surface extends substantially straight from the rotor open end to the fiber collecting groove, and wherein said exterior wall surface is curved so as to define an annular wall of varying radial thickness along an axial extent of the annular wall from the rotor open end to the fiber collecting groove with a thinner wall section adjacent the fiber collecting groove and a thicker wall section intermediate the thinner wall section and the rotor open end, and with thickness of the wall being increased by a curved widening contour.

10. An open-end spinning rotor according to claim 9, wherein the exterior wall surface is at least partly convexly shaped adjacent the thicker wall section.

11. An open-end spinning rotor according to claim 9, wherein the exterior wall surface is at least partly concavely shaped adjacent the thinner wall section.

12. An open-end spinning rotor according to claim 10, wherein the exterior wall surface is at least partly concavely shaped adjacent the thinner wall section.

13. An open-end spinning rotor comprising:

An annular wall extending conically from a rotor open-end to form a fiber collecting groove at a largest diameter section of the annular wall, and a rotor base extending from the fiber collecting groove to a rotor support section, wherein said annular wall exhibits an interior wall surface facing radially inwardly toward a rotor rotational axis and a radially outwardly facing exterior wall surface, wherein said interior wall surface extends substantially straight from the rotor open end to the fiber collecting groove, and wherein said exterior wall surface is curved so as to define an annular waH of varying radial thickness along an axial extend of the annular wall from the rotor open end to the fiber collecting groove with a thinner wall section adjacent the fiber collecting groove and a thicker wall section intermediate the thinner wall section and the rotor open end wherein the thicker wall section is maximally between 10 and 25 percent thicker than the thinnest part of the thinner wall section.

14. An open-end spinning rotor according to claim 10, wherein the thicker wall section is maximally between 10 and 25 percent thicker than the thinnest part of the thinner wall section.

15. An open-end spinning rotor according to claim 11, wherein the thicker wall section is maximally between 10 and 25 percent thicker than the thinnest part of the thinner wall section.

16. An open-end spinning rotor according to claim 12, wherein the thicker wall section is maximally between 10 and 25 percent thicker than the thinnest part of the thinner wall section.

17. An open-end spinning rotor according to claim 9, wherein the thinnest part of the thinner wall section is about 1.1 mm thick.

18. An open-end spinning rotor according to claim 9, wherein the thickest part of the thicker wall section is about 1.35 mm thick.

19. An open-end spinning rotor according to claim 17, wherein the thickest part of the thicker wall section is about 1.35 mm thick.

20. An open-end spinning rotor according to claim 9, wherein, in the area of the largest outer diameter, the wall thickness of the rotor base measures 1.5 times to twice the size of the smallest wall thickness.

21. An open-end spinning rotor according to claim 13, wherein, in the area of the largest outer diameter, the wall thickness of the rotor base measures 1.5 times to twice the size of the smallest wall thickness.

* * * * *